US012179966B2

(12) United States Patent
Vue et al.

(10) Patent No.: US 12,179,966 B2
(45) **Date of Patent: *Dec. 31, 2024**

(54) SLIDE-LOCK LID

(71) Applicant: Fellow Industries, Inc., San Francisco, CA (US)

(72) Inventors: Pajnucci Vue, Palo Alto, CA (US); Nicholas Terzulli, San Francisco, CA (US)

(73) Assignee: Fellow Industries, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/131,257

(22) Filed: Apr. 5, 2023

(65) Prior Publication Data

US 2023/0264867 A1 Aug. 24, 2023

Related U.S. Application Data

(63) Continuation of application No. 17/680,274, filed on Feb. 24, 2022, now Pat. No. 11,649,094.

(51) Int. Cl.
*B65D 47/26* (2006.01)
*B65D 47/28* (2006.01)

(52) U.S. Cl.
CPC ..... *B65D 47/268* (2013.01); *B65D 47/286* (2013.01); *B65D 2205/00* (2013.01)

(58) Field of Classification Search
CPC . B65D 47/268; B65D 47/286; B65D 2205/00
USPC ..... 222/408, 153.01, 153.11–153.14
See application file for complete search history.

(56) References Cited

U.S. PATENT DOCUMENTS 6,752,287 B1 * 6/2004 Lin ..... A47G 19/2272 220/254.9
10,336,513 B2 * 7/2019 Wodka ..... B65D 47/249
10,870,522 B2 * 12/2020 Lane ..... B65D 43/0229
11,589,695 B2 * 2/2023 Spivey ..... B65D 43/16
(Continued)

OTHER PUBLICATIONS

International Search Report and Written Opinion in PCT International Application No. PCT/US2023/013775 mailed Feb. 24, 2023.

*Primary Examiner* — Paul R Durand
*Assistant Examiner* — Michael J. Melaragno
(74) *Attorney, Agent, or Firm* — Cognition IP, P.C.; Edward Steakley; Justin White

(57) ABSTRACT

A portable beverage container lid can include a main outer housing, a slider top assembly coupled thereto, a carrier disposed therewithin, and beverage and vent seals coupled to the carrier. The main outer housing can include a beverage opening and a vent opening. The slider top assembly can slide laterally between open and closed positions. The carrier can move when the slider top assembly slides laterally. The beverage seal can close the beverage opening when the slider top assembly is in the closed position and allow the beverage to pass through the beverage opening when the slider top assembly is in the closed position. The vent seal can close the vent opening when the slider top assembly is in the closed position and allow air to pass through the vent opening when the slider top assembly is in the closed position. The beverage and vent seals can be actuated simultaneously.

20 Claims, 10 Drawing Sheets

(56) References Cited

U.S. PATENT DOCUMENTS

| | | | | |
|---|---|---|---|---|
| 11,649,094 | B1 * | 5/2023 | Vue | B65D 47/268 222/408 |
| 11,718,455 | B2 * | 8/2023 | Jinkins | B65D 47/286 220/254.9 |
| 11,814,223 | B1 * | 11/2023 | Seiders | A47G 19/2272 |
| 2012/0037651 | A1 * | 2/2012 | Steuer | B65D 47/249 220/714 |
| 2013/0319966 | A1 * | 12/2013 | Lane | A45F 3/20 215/237 |
| 2016/0270572 | A1 * | 9/2016 | Karussi | A47G 19/2272 |
| 2017/0066573 | A1 * | 3/2017 | Karussi | B65D 81/3869 |
| 2018/0170630 | A1 * | 6/2018 | Ayriss | B65D 47/32 |
| 2018/0332987 | A1 * | 11/2018 | Lin | B65D 47/305 |
| 2020/0055645 | A1 * | 2/2020 | Lane | A47G 19/2272 |
| 2020/0231345 | A1 * | 7/2020 | Lane | B65D 47/248 |
| 2020/0391910 | A1 * | 12/2020 | Pinelli | A47G 19/2272 |
| 2022/0112011 | A1 * | 4/2022 | McNamara | B65D 51/18 |
| 2022/0135294 | A1 * | 5/2022 | Peng | B65D 47/0871 220/203.01 |

* cited by examiner

SLIDE-LOCK LID

CROSS-REFERENCE TO RELATED APPLICATION

This application is a continuation of and claims priority to commonly owned U.S. patent application Ser. No. 17/680,274, filed Feb. 24, 2022, which is hereby incorporated by reference in its entirety.

TECHNICAL FIELD

The present disclosure relates generally to liquid containers, and more particularly to lids for portable beverage containers.

BACKGROUND

Portable beverage containers are ubiquitous, with users carrying their beverages in water bottles, canteens, travel mugs, and the like. These portable beverage containers often have lids of various types to limit or prevent spillage when the containers are not in use. For example, many portable coffee mugs utilize lids that allow users to drink coffee and other beverages with relative ease while they are on the go. Simpler lids can merely have small drinking openings, while others can include a mechanism that allows the drinking opening to be closed off Unfortunately, many such closing mechanisms can be cumbersome to operate, often requiring full attention of the user and the use of both hands. Simpler closing mechanisms may also allow some leakage while closed and/or provide inadequate venting when the mechanism is open and the beverage container is in use. Further, many such closing mechanisms have designs that are not aesthetically pleasing. For example, some simpler travel mug lids have a sliding closing mechanism that can be operated with one hand while the other hand holds the travel mug. While these sliding closing mechanisms can be slid into a closed position, they sometimes allow leakage while closed. They can also provide poor venting while in an open position.

Although traditional portable beverage lids have worked in the past, improvements are always helpful. In particular, what is desired are portable beverage container lids that fully prevent leakage, provide good venting, are easy to operate, and are aesthetically pleasing.

SUMMARY

It is an advantage of the present disclosure to provide improved lids for fluid containers, which can include portable beverage containers such as coffee travel mugs, among other possible fluid containers. The disclosed lids fully prevent leakage, provide good venting, are easy to operate, and are aesthetically pleasing, among other improvements. These advantages can be accomplished at least in part by utilizing a slide-lock lid arrangement that is leak proof, has multiple fluid passages and seals, requires only one hand to operate, and has a sleek and attractive appearance. A cooling well built into the slide-lock lid also minimize burning from coffee and other hot beverages during use.

In various embodiments of the present disclosure, an apparatus can include a main outer housing, a slider top assembly, a carrier, a first fluid seal, and a second fluid seal. The main outer housing can have a first fluid opening for a first fluid to pass therethrough and a second fluid opening for a second fluid to pass therethrough. The slider top assembly can be coupled to the main outer housing and can be configured to slide laterally between an open position and a closed position with respect to the main outer housing. The carrier can be disposed within the main outer housing and can be configured to move when the slider top assembly slides laterally with respect to the main outer housing. The first fluid seal can be coupled to the carrier and can be configured to close the first fluid opening when the slider top assembly is in the closed position and allow the first fluid to pass through the first fluid opening when the slider top assembly is in the closed position. The second fluid seal can be coupled to the carrier and can be configured to close the second fluid opening when the slider top assembly is in the closed position and allow the second fluid to pass through the second fluid opening when the slider top assembly is in the closed position.

In various detailed embodiments, the apparatus can be configured to be a lid for a portable beverage container. In such instances, the first fluid can be a beverage, the first opening can be a beverage opening, the second fluid can be air, and the second opening can be an air vent. In some arrangements, the slider top opening can be configured to be operated by a user with one hand while the one hand also holds a fluid container associated with the apparatus. The apparatus can also include a piston disposed within the main outer housing and coupled to the carrier, wherein the piston causes the carrier to move when the slider top assembly slides laterally with respect to the main outer housing. The piston and carrier can move vertically as a combined assembly when the slider top assembly slides laterally. Also, the piston can be spring-loaded to force the first fluid seal and the second fluid seal to close when the slider top assembly is in the closed position. The slider top assembly can define a bottom surface having a feature that contacts and slides along the top of the piston when the slider top assembly slides laterally between the open position and the closed position. This feature can include a curved portion that pushes the piston downward as the slider top assembly slides from the closed position to the open position.

In further detailed embodiments, the slider top assembly can define an upper surface that is disposed at a first angle with respect to the main outer housing when the slider top assembly is in the closed position. The upper surface can also be disposed at a second angle with respect to the main outer housing when the slider top assembly is in the open position. The difference between the first angle and the second angle can be about ten degrees. In some arrangements, the main outer housing can include a cooling well integrally formed therein, with the cooling well being configured to allow the first fluid to cool after the first fluid passes through the first opening and is still within the main outer housing. The slider top assembly can include integrally formed rails and the main outer housing can include integrally formed tracks, and the rails can slide along the tracks when the slider top assembly slides laterally between the open position and the closed position with respect to the main outer housing.

In various further embodiments of the present disclosure, a portable beverage container lid can include a main outer housing, a slider top assembly, a carrier, a beverage seal, and a vent seal. The main outer housing can have a beverage opening for a beverage to pass therethrough and a vent opening for air to pass therethrough. The slider top assembly can be coupled to the main outer housing and can be configured to slide laterally between an open position and a closed position with respect to the main outer housing. The carrier can be disposed within the main outer housing and can be configured to move when the slider top assembly slides laterally with respect to the main outer housing. The beverage seal can be coupled to the carrier and can be configured to close the beverage opening when the slider top assembly is in the closed position and allow the beverage to pass through the beverage opening when the slider top assembly is in the closed position. The vent seal can be coupled to the carrier and can be configured to close the vent opening when the slider top assembly is in the closed position and allow air to pass through the vent opening when the slider top assembly is in the closed position. The portable beverage container lid can be configured so that sliding the slider top assembly to the open position can open both the beverage seal and vent seal simultaneously.

In various detailed embodiments, the portable beverage container lid can also include a spring-loaded piston disposed within the main outer housing and coupled to the carrier. The piston and carrier can move vertically as a combined assembly when the slider top assembly slides laterally with respect to the main outer housing. Also, the slider top assembly can define a bottom surface having a curved portion that contacts and slides along the top of the piston and pushes the piston downward when the slider top assembly slides laterally between the open position and the closed position. The slider top assembly can also define an upper surface that is disposed at a first angle with respect to the main outer housing when the slider top assembly is in the closed position and is disposed at a second angle with respect to the main outer housing when the slider top assembly is in the open position. The difference between the first angle and the second angle can be about ten degrees. The main outer housing can include a cooling well integrally formed therein, with the cooling well being configured to allow the beverage to cool after the beverage passes through the beverage opening and is still within the main outer housing.

In still further embodiments of the present disclosure, a portable beverage container can include a main reservoir configured to hold a beverage therein and a lid removably coupled to the main reservoir. The lid can include a main outer housing, a slider top assembly, a carrier, a beverage seal, and a vent seal. These components can have some or all of the foregoing features from the previous embodiments in any combination.

Other apparatuses, methods, features, and advantages of the disclosure will be or will become apparent to one with skill in the art upon examination of the following figures and detailed description. It is intended that all such additional apparatuses, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed systems, apparatuses, features, and methods for beverage container lids. These drawings in no way limit any changes in form and detail that may be made to the disclosure by one skilled in the art without departing from the spirit and scope of the disclosure.

DETAILED DESCRIPTION

Exemplary applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details provided herein. In some instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to systems, apparatuses, and features for high-quality fluid container lids. In particular, the disclosed systems, apparatuses, and features provide portable beverage container lids that fully prevent leakage, provide good venting, are easy to operate, and are aesthetically pleasing, among other benefits.

In various embodiments, slide-lock lids can include

Although the various embodiments disclosed herein focus on lids for beverage containers, such as portable coffee mugs, for purposes of simplicity in illustration, it will be readily appreciated that the disclosed systems, apparatuses, and features can similarly be used for any other kind of fluid container. For example, the disclosed systems, apparatuses and features can be used for watering cans, fuel dispensers, and any other form of fluid holding device.

Figure 1:
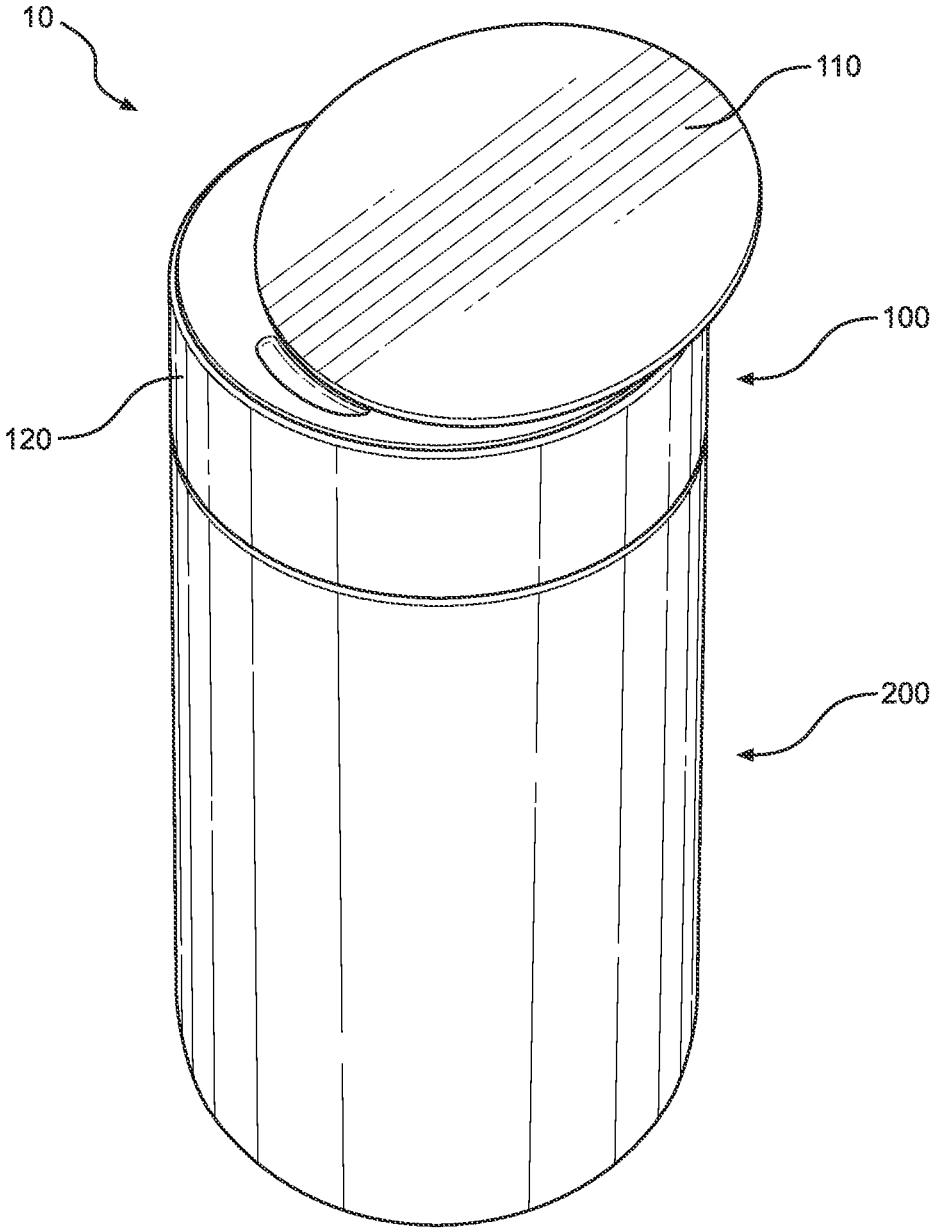
FIG. 1 illustrates in front perspective view an example beverage container according to one embodiment of the present disclosure.

Referring first to FIG. 1, an example beverage container 10 is shown in front perspective view. Beverage container 10 can include a lid 100 and a main reservoir 200 configured to hold a beverage such as coffee therein. In various embodiments, lid 100 can be removable from main reservoir 200, such as by way of a threaded arrangement. Both lid 100 and main reservoir 200 can be reusable and can be easily cleaned when separated from each other. In a particular example, beverage container 10 can be a travel coffee mug.

Lid 100 can be referred to as a "slide-lock" lid and can have various components to facilitate sleek and smooth opening and closing operations. For example, a slider top assembly 110 at the top of the slide-lock lid 100 can slide between open and closed positions. As shown in FIG. 1, slider top assembly 110 is slid to an open position with respect to a main outer housing 120 of the slide-lock lid 100.

Figure 2:
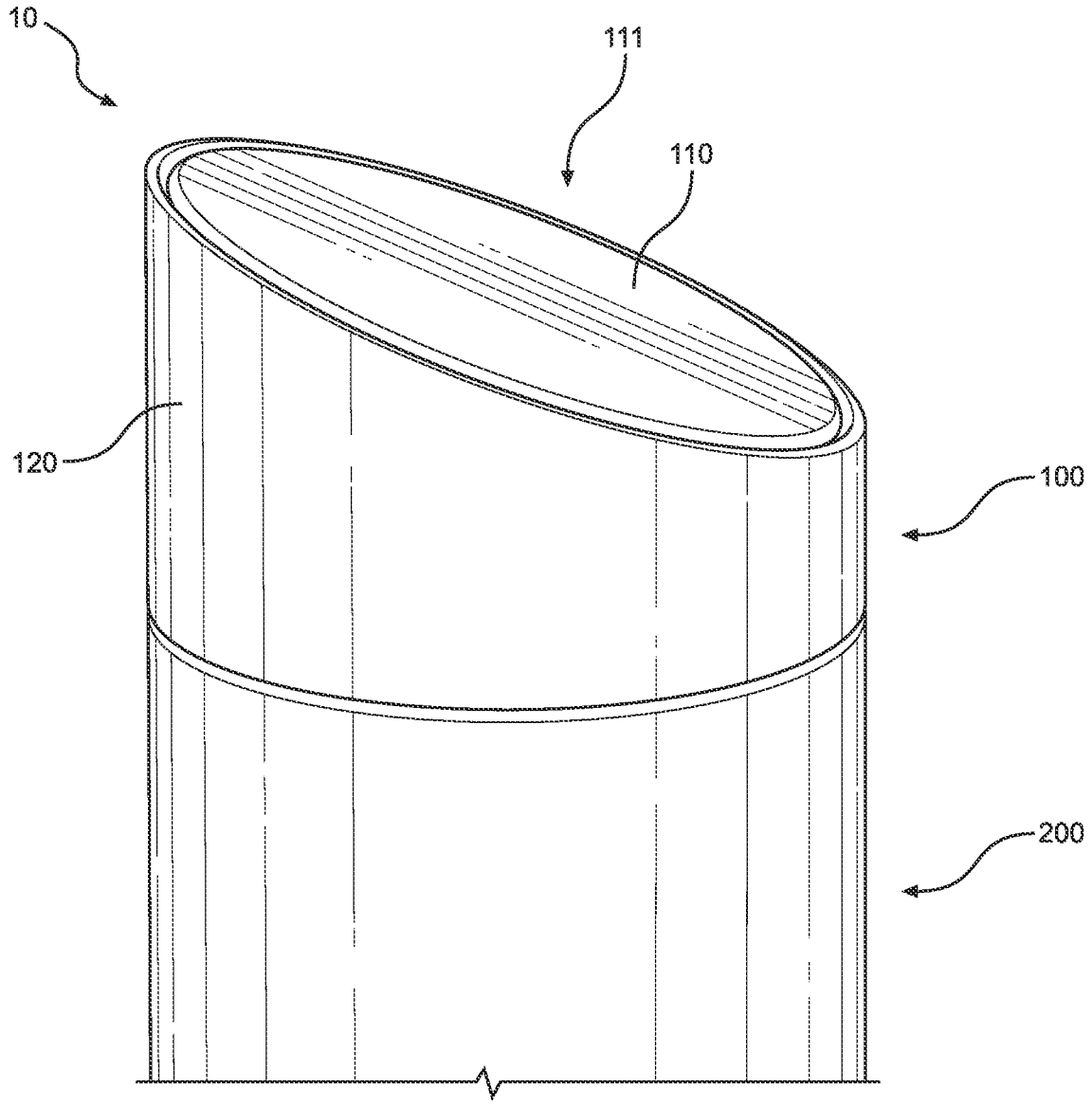
FIG. 2 illustrates in side perspective view the beverage container of FIG. 1 according to one embodiment of the present disclosure.

Continuing with FIG. 2, the beverage container of FIG. 1 is alternatively shown in side perspective view. Again, beverage container 10 can include a main reservoir 200 and a lid 100, which in turn can include a slider top assembly 110 and a main outer housing 120, among other various components, as detailed below. As shown in FIG. 2, slider top assembly 110 is slid to a closed position with respect to a main outer housing 120 of the slide-lock lid 100. Slider top assembly 110 can define an upper surface 111 that resides at a first angle (i.e., closed angle) with respect to main outer housing 120 when it is in this closed position. In various arrangements, upper surface 111 can reside slightly above an outer circumference lip of main outer housing 120 as shown, so as to present a more aesthetically pleasing appearance.

Figure 3A:
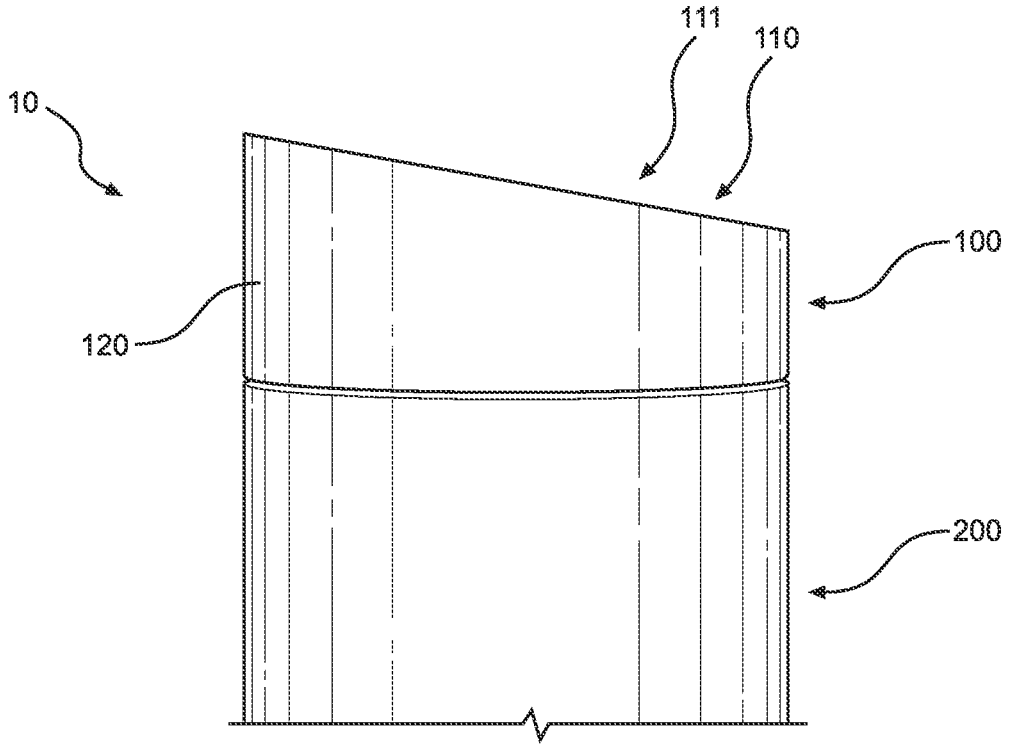
FIG. 3A illustrates in side elevation view the beverage container of FIG. 1 in a closed position according to one embodiment of the present disclosure.
Figure 3B:
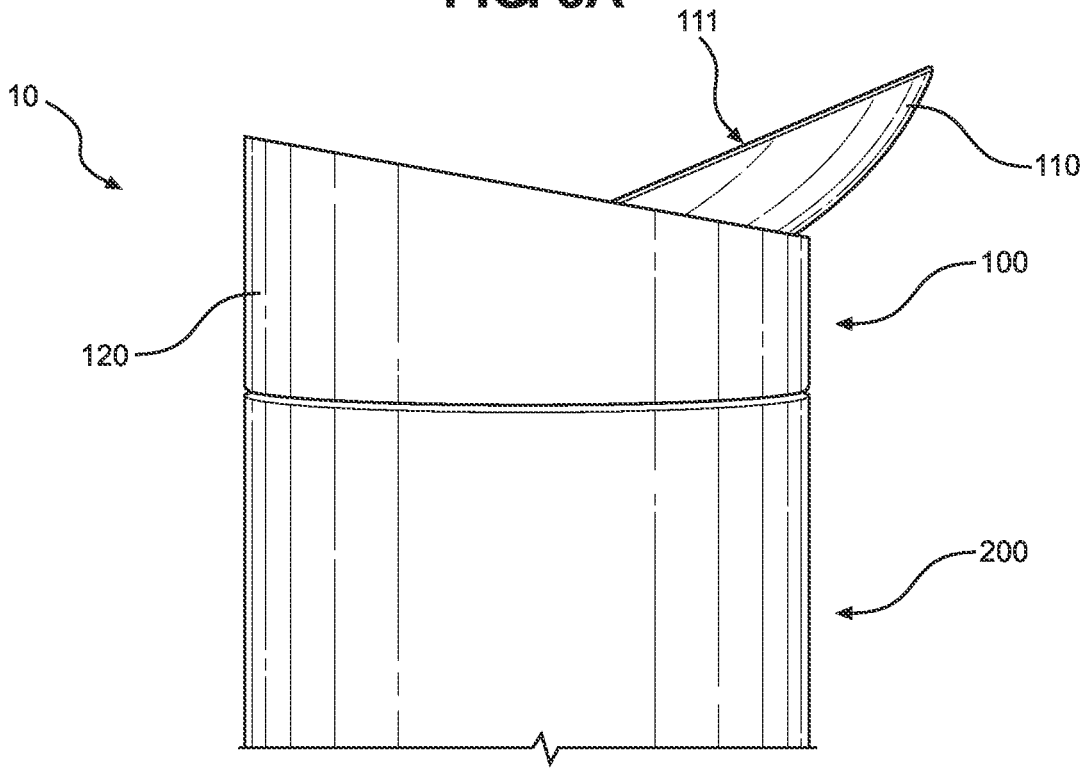
FIG. 3B illustrates in side elevation view the beverage container of FIG. 1 in an open position according to one embodiment of the present disclosure.

FIGS. 3A and 3B illustrate in side elevation views the beverage container of FIG. 1 in closed and open positions respectively. As shown in FIG. 3A, slider top assembly 110 is not visible from a side elevation perspective when it is slid into a closed position. Conversely, slider top assembly slides 110 from left to right and in so doing pivots upward when it is moved from a closed to an open position, as shown in FIG. 3B. Upper surface 111 then resides at a second angle with respect to main outer housing 120 when it is in this open position. In various embodiments, the first angle can be different than the second angle of the upper surface 111. For example, the difference between the first and second angles can be about 10 degrees. Other differences in angle are also possible, as may be desired.

Figure 4:
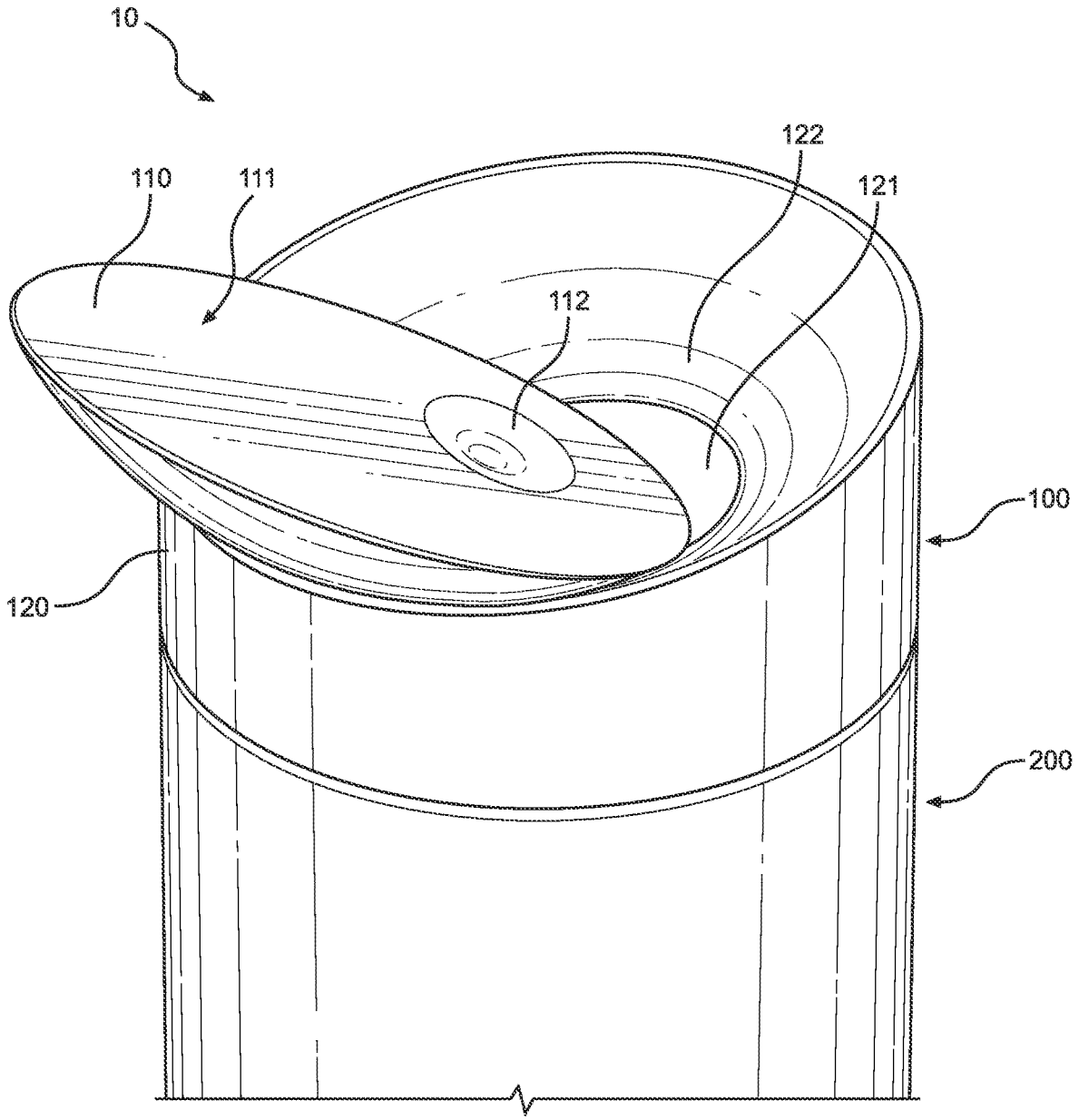
FIG. 4 illustrates in obverse perspective view the beverage container of FIG. 1 in an open position according to one embodiment of the present disclosure.

Continuing with FIG. 4, beverage container 10 is shown in obverse perspective view in an open position. As can be seen in comparison with FIG. 2, which depicts a closed position, slider top assembly 110 has slid to an open position and in so doing has changed the angle of upper surface 111 with respect to main outer housing 120. An indentation 112 integrally formed on upper surface 111 can help to readily facilitate the sliding action of slider top assembly 110 between open and closed positions. For example, a user can place a thumb within indentation 112 to push forward or backward on slider top assembly 110 to move it as desired. In some arrangements, the thumb on the same hand holding beverage container 10 can be used for this purpose. Accordingly, a single hand can be used to hold the beverage container 10 and also manually operate the slider top assembly 110 between open and closed positions.

When in the open position, a beverage opening (i.e., first fluid opening) 121 can be exposed. This beverage opening 121 can be integrally formed in main outer housing 120 of slide-top lid 100. A user can then drink a beverage contained within beverage container 10 through this beverage opening 121 when beverage container 10 is in this open position. In some arrangements, a cooling well 122 can be integrally formed in main outer housing 120. Such a cooling well 122 can facilitate a slight cooling of coffee or any other hot beverage after the beverage has passed through beverage opening 121 and is still within main outer housing 120.

Figure 5:
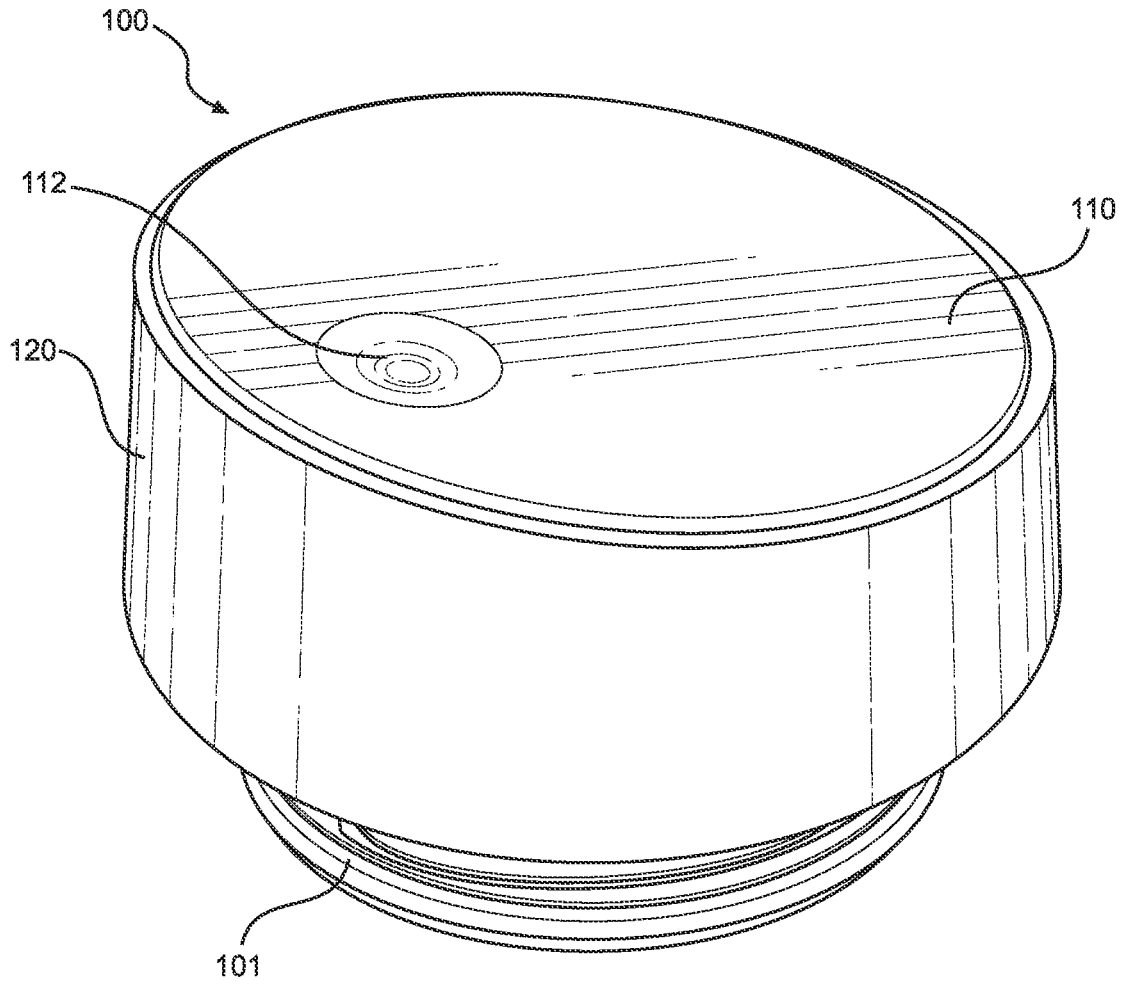
FIG. 5 illustrates in front perspective view an example slide-lock lid according to one embodiment of the present disclosure.

Transitioning now to FIG. 5, an example slide-lock lid is shown in front perspective view. Slide-lock lid 100 has been removed from an associated liquid container, such as a portable beverage container. This can be the beverage reservoir 200 of FIG. 1, for example. Removal from the associated liquid container can be facilitated by way of any suitable coupling arrangement, such as a threaded arrangement 101, for example. Again, slide-lock lid 100 can include a slider top assembly 110 that slides back and forth between open and closed positions with respect to a main outer housing 120. An indentation 112 can facilitate such a manual sliding action by the user. As shown in FIG. 5, slide-lock lid 100 is in a closed position.

Figure 6:
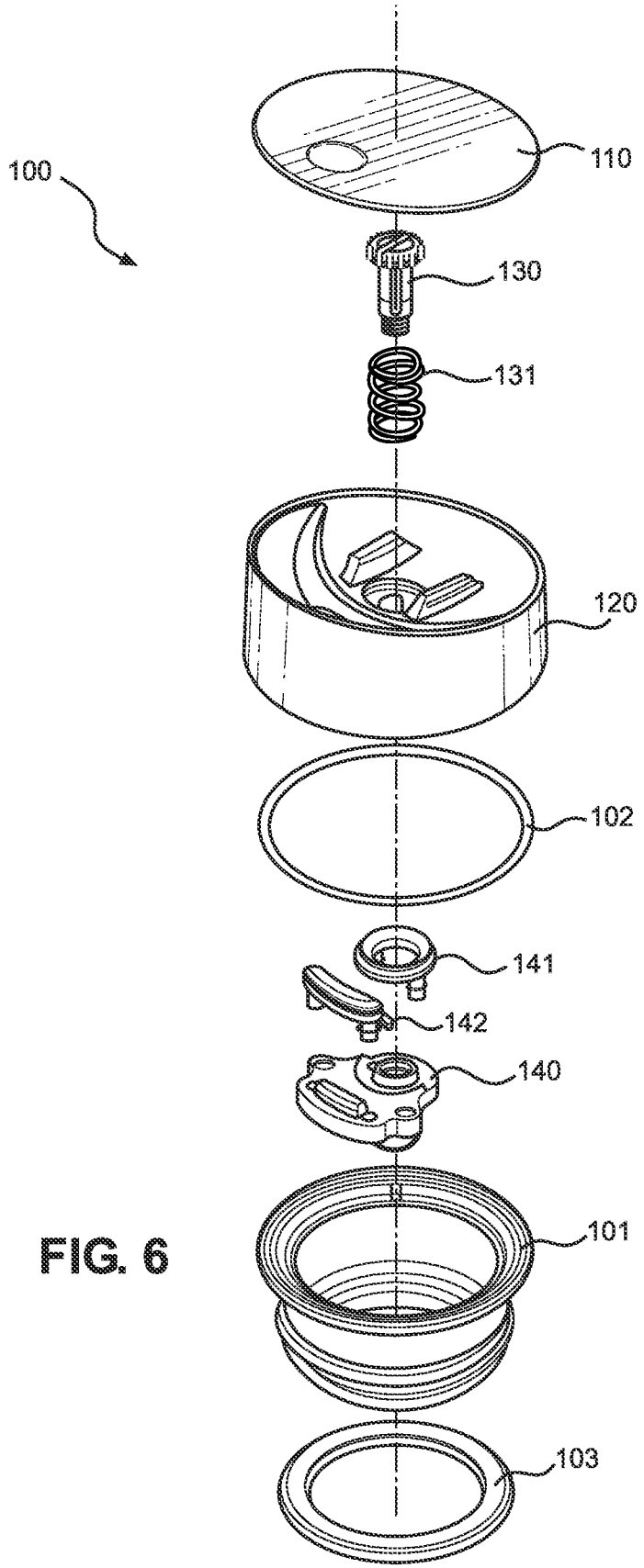
FIG. 6 illustrates in exploded view the slide-lock lid of FIG. 5 according to one embodiment of the present disclosure.

FIG. 6 illustrates in exploded view the slide-lock lid of FIG. 5 according to one embodiment of the present disclosure. As will be readily appreciated, slide-lock lid 100 can include a variety of components to facilitate its functions as a portable beverage container lid that fully prevents leakage, provides good venting, is easy to operate, and is aesthetically pleasing. In order, slide-lock lid 100 can include a slider top assembly 110, a piston 130, a biasing spring 131, a main outer housing 120, an O-ring 102, a vent seal 141, a beverage seal 142, a carrier 140, a threaded arrangement 101, and a bottom gasket 103. Beverage seal 142 can be considered a first fluid seal, while vent seal 141 can be considered a second fluid seal. O-ring 102, vent seal 141, beverage seal 142, and bottom gasket 103 can all be considered gaskets or seals.

Piston 130 can be coupled to carrier 140, which in turn is coupled to both vent seal 141 and beverage seal 142 to form a combined assembly of these components. Slider top assembly 110 can be arranged to provide a downward force to piston 130 when slider top assembly 110 slides from a closed position to an open position. This can result in piston 130 moving downward, which also moves carrier 140, vent seal 141, and beverage seal 142 downward as a combined assembly with piston 130. Downward motion of the piston, carrier, beverage seal and vent seal assembly correspondingly moves beverage seal 142 and vent seal 141 away from beverage and vent openings respectively to open the overall slide-lock lid 100. Biasing spring 131 can be configured to bias piston 130 in an upward direction such that the combined assembly of piston 130, carrier 140, vent seal 141, and beverage seal 142 is forced in an upward position to close the vent and beverage seals against their respective openings when slide-lock lid 100 is in the closed position. These relationships and details thereof can be seen with respect to the figures below, such as the cross-section view shown in FIG. 9.

Figure 7A:
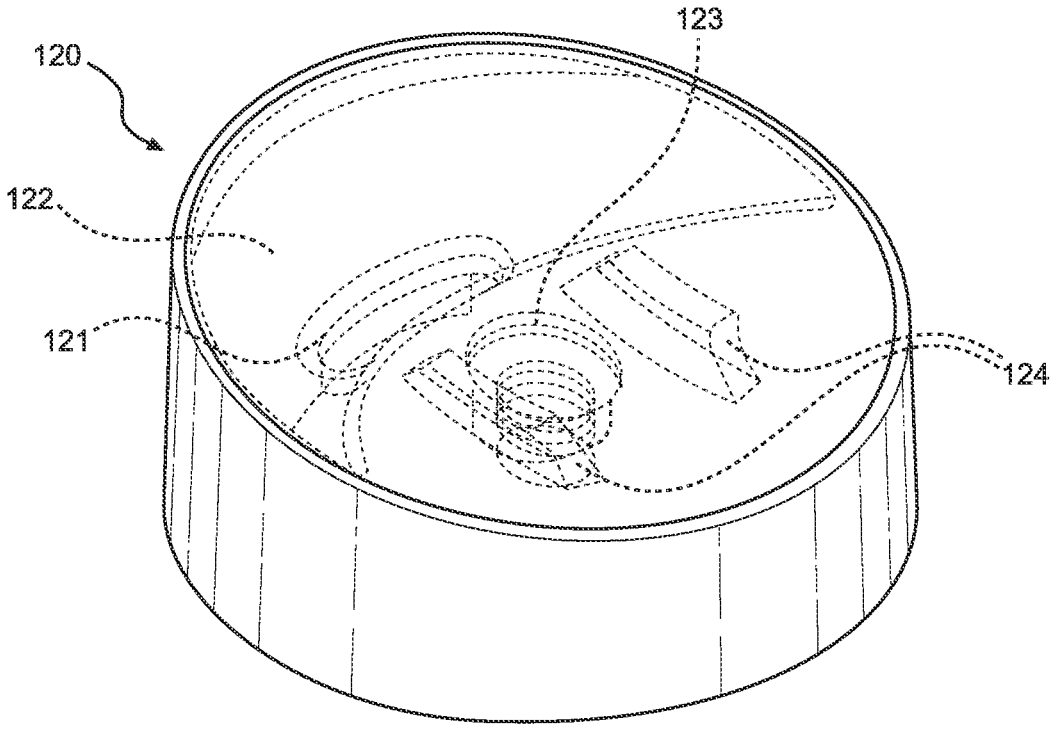
FIG. 7A illustrates in top perspective view an example main outer housing for a slide-lock lid according to one embodiment of the present disclosure.
Figure 7B:
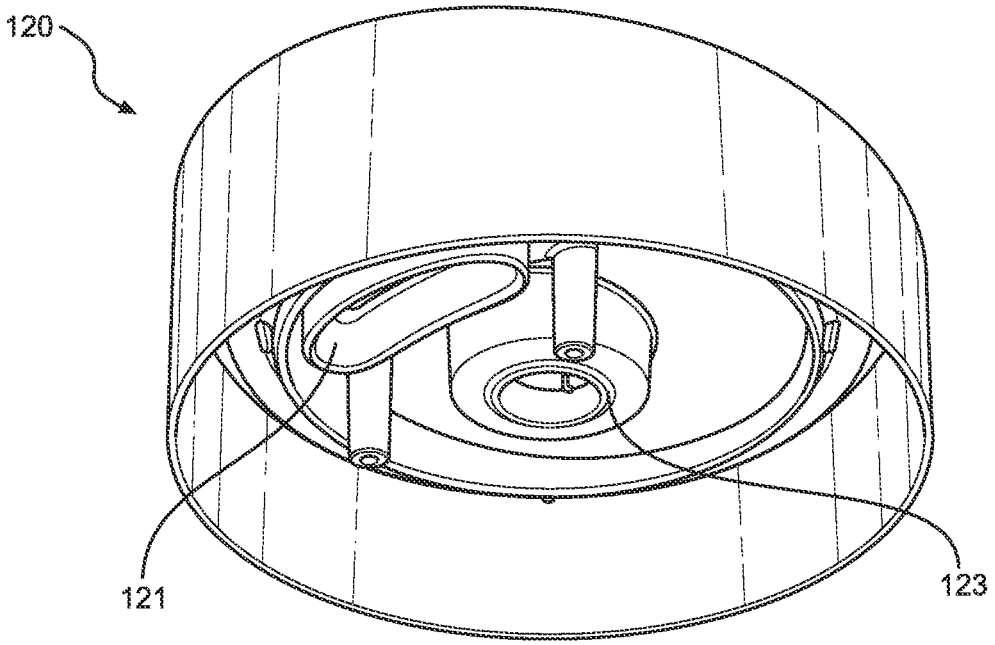
FIG. 7B illustrates in bottom perspective view the main outer housing of FIG. 7A according to one embodiment of the present disclosure.

Turning next to FIGS. 7A and 7B, an example main outer housing for a slide-lock lid is illustrated in top perspective and bottom perspective views respectively. Main outer housing 120 can include a beverage opening 121, a cooling well 122, a vent opening 123, and tracks 124, among other possible features. Beverage opening 121, which can also be referred to as a mouth opening or first fluid opening, can allow beverage to pass therethrough from an associated beverage or fluid reservoir to a user. Cooling well 122 can allow a hot beverage to cool after it has passed through beverage opening 121 and is still within main outer housing 120. Vent opening 123, which can also be referred to as a second fluid opening, can allow air to pass therethrough so as to facilitate a smooth flow of beverage through the beverage opening 121, as will be readily appreciated. Tracks 124 can mate with associated rails (as noted below) on an associated slider track assembly so as to facilitate a smooth and directed sliding motion of the slider track assembly.

Each of features 121, 122, 123, 124 can be integrally formed within main outer housing 120. For example, main outer housing 120 can be a singularly formed molded plastic material. Alternatively, one or more of features 121, 122, 123, 124 can be formed from a separate component coupled to main outer housing 120. Main outer housing 120 can also be formed of any other suitable material besides a molded plastic material. For example, a suitable metal material may also be used.

Figure 8A:
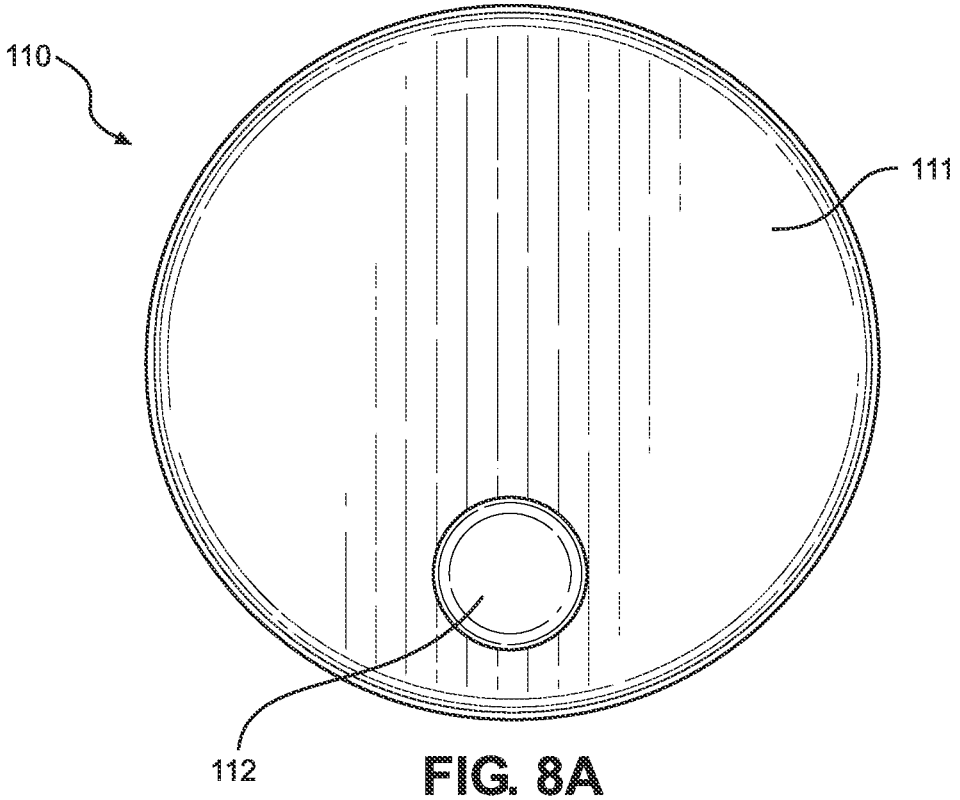
FIG. 8A illustrates in top plan view an example slider top assembly for a slide-lock lid according to one embodiment of the present disclosure.
Figure 8B:
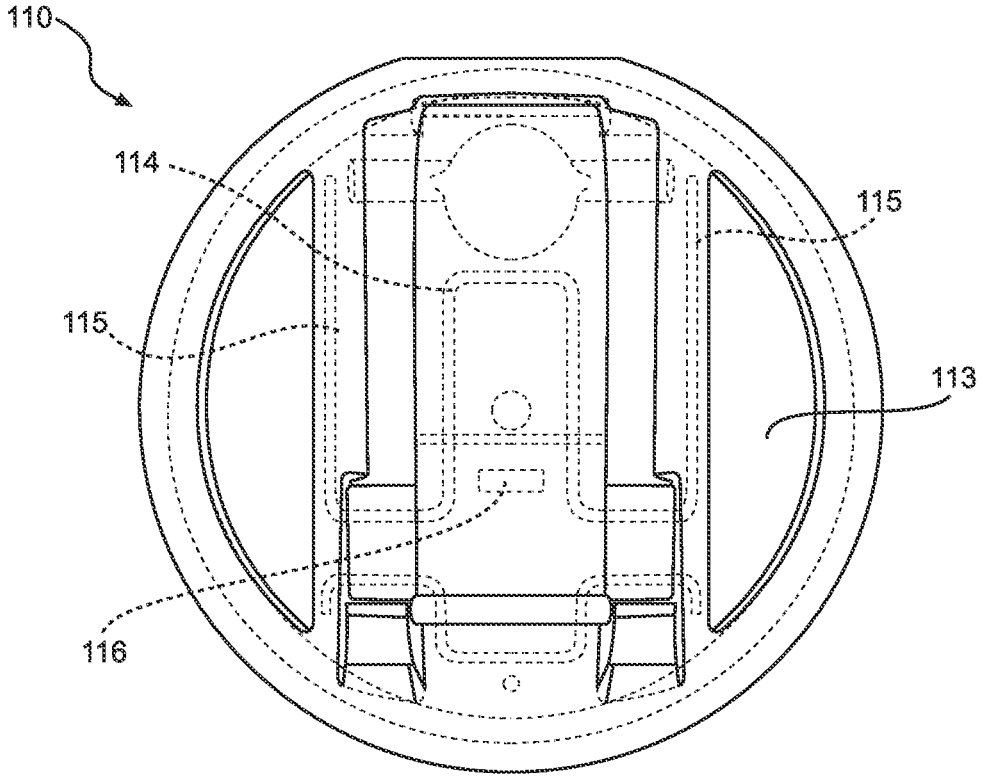
FIG. 8B illustrates in bottom plan view the slider top assembly of FIG. 8A according to one embodiment of the present disclosure.

Continuing with FIGS. 8A and 8B, an example slider top assembly for a slide-lock lid is shown in top plan and bottom plan views respectively. Slider top assembly 110 can include an upper surface 111, an indentation 112, a bottom surface 113, a curved portion (i.e. feature) 114, rails 115, and a detent 116, among other possible features. Upper surface 111 can present as the top of slider top assembly 110 and can include indentation 112 to facilitate ease of use. Bottom surface 113 can include each of curved portion 114, rails 115, and detent 116. Curved portion 114 can be a feature that contacts the top of an associated piston (not shown) and pushes the piston downward. In particular, curved portion 114 slides along the top of the piston and pushes it downward as slider top assembly 110 slides from a closed position to an open position. Rails 115 mate with associated tracks on an associated slider track assembly to facilitate a smooth and directed sliding motion of the slider top assembly 110 between open and closed positions, as noted above. Detent 116 provides a mechanical stop against the associated piston when the slider top assembly 110 reaches a fully open position so as to prevent the slider top assembly from sliding off the associated main outer housing during regular use.

Each of features 111, 112, 113, 114, 115, 116 can be integrally formed within slider top assembly 110. For example, slider top assembly 110 can also be a singularly formed molded plastic material. Alternatively, one or more of features 111, 112, 113, 114, 115, 116 can be formed from a separate component coupled to slider top assembly 110. Slider top assembly 110 can also be formed of any other suitable material besides a molded plastic material. For example, a suitable metal material may also be used.

Figure 9:
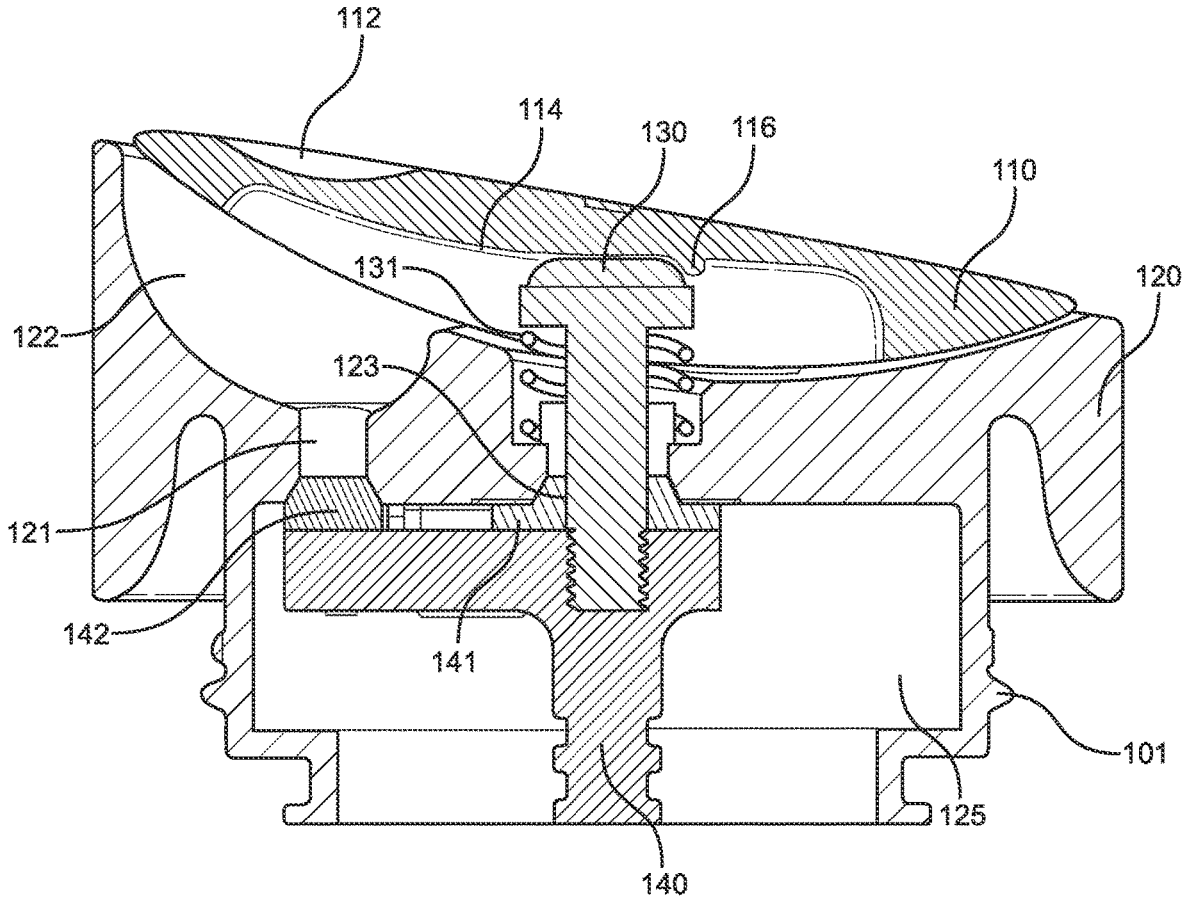
FIG. 9 illustrates in side cross-section view the slide-lock lid of FIG. 5 according to one embodiment of the present disclosure.

Moving next to FIG. 9 the slide-lock lid of FIG. 5 is depicted is side cross-section view. As noted above, slide-lock lid 100 can include a slider top assembly 110 that is removably coupled to and slidable with respect to a main outer housing 120. As shown in FIG. 9, slide-lock lid 100 is in a closed position, such that slider top assembly 110 slides toward the right with respect to the view shown when the slider top assembly slides to an open position. As noted above, the angle of slider top assembly 110 changes as it slides from a closed to an open position, such that the end having indentation 112 is lowered while the opposite end of the slider top assembly is raised. Main outer housing 120 does not move during such a sliding operation. A threaded arrangement 101 at the bottom of main outer housing 120 can be used to removably couple the entire slide-lock lid 100 to an associated beverage container or other fluid reservoir.

While slide-lock lid 100 is in the closed position, coffee or another beverage or fluid may enter a hollow region 125 within main outer housing 120 since the bottom of main outer housing 120 is open and hollow where it couples to an associated beverage container. The coffee or other fluid cannot exit or leak from the slide-lock lid, however, due to the presence of beverage seal 142 sealing off beverage opening 121 and vent seal 141 sealing off vent opening 123 when the entire arrangement is in the closed position.

When slider top assembly 110 is slid into an open position (not shown in FIG. 9), a curved portion 114 along the bottom surface of the slider top assembly 110 slides along and pushes downward against the top of piston 130 in a cam action. This causes the piston 130 to be pushed downward vertically as the slider top assembly 110 slides from left to right with respect to the view shown in FIG. 9. Piston 130 can be removably coupled to carrier 140, such that downward movement of the piston also moves the carrier downward. Beverage seal 142 and vent seal 141 can be coupled to carrier 140, such that downward movement of the carrier also moves the beverage and vent seals downward, thus opening beverage opening 121 and vent opening 123. A detent 116 located on the bottom surface of slider top assembly 110 can prevent the slider top assembly from sliding past a fully open position and coming completely detached from the main outer housing 120 during ordinary use.

When slider top assembly 110 is slid into an open position, coffee, beverage, or other fluid contained within hollow region 125 can flow through open beverage opening 121 with adequate venting provided through open vent opening 123, such as when the entire arrangement is tilted to allow fluid flow. Notably, a single sliding operation of the slider top assembly 110 actuates both beverage and vent seals 142, 141 simultaneously. After the coffee or other beverage or fluid has passed through the beverage opening 121, it can be slightly cooled within a cooling well 122 prior to being consumed or otherwise expelled from the slide-lock lid 100.

When the slider top assembly 110 of slide-lock lid 100 is slid from an open position to a closed position, a biasing spring 131 situated about piston 130 can push the piston upward against the bottom surface of the slider top assembly 110. This can then cause the carrier 140 coupled to the piston 130 to be pushed upward, which also causes the beverage seal 142 and vent seal 141 to seal off their respective openings. In some arrangements, an additional protrusion on the bottom surface of the slider top assembly 110 can snap into a hollow region atop piston 130, such that a snapping or locking effect is achieved as the slider top assembly reaches a fully closed position. A slight static force can be provided by this protrusion and hollow region arrangement, which can prevent the entire device from slipping open but which can also be overcome with a slight manual force by a user.

In various embodiments, various components of slide-lock lid 100 can be disassembled to allow for easier cleaning, maintenance, and interchangeability of parts. For example, slider top assembly 110 can be completely removed from main outer housing 120 in some arrangements. This can be accomplished by allowing a user to manually override the function provided by detent 116. When slide-lock lid 100 is unscrewed or otherwise removed from an associated beverage container or other fluid reservoir, a user can reach into hollow region 125 and pull down on the bottom of carrier 140. This can override the force of biasing spring 131 and serve to pull the entire carrier, seal and piston assembly downward such that detent 116 will no longer cause slider top assembly 110 to stop at a fully open position, and the slider top assembly can continue to be slid completely off of the main outer housing 120.

Figure 10A:
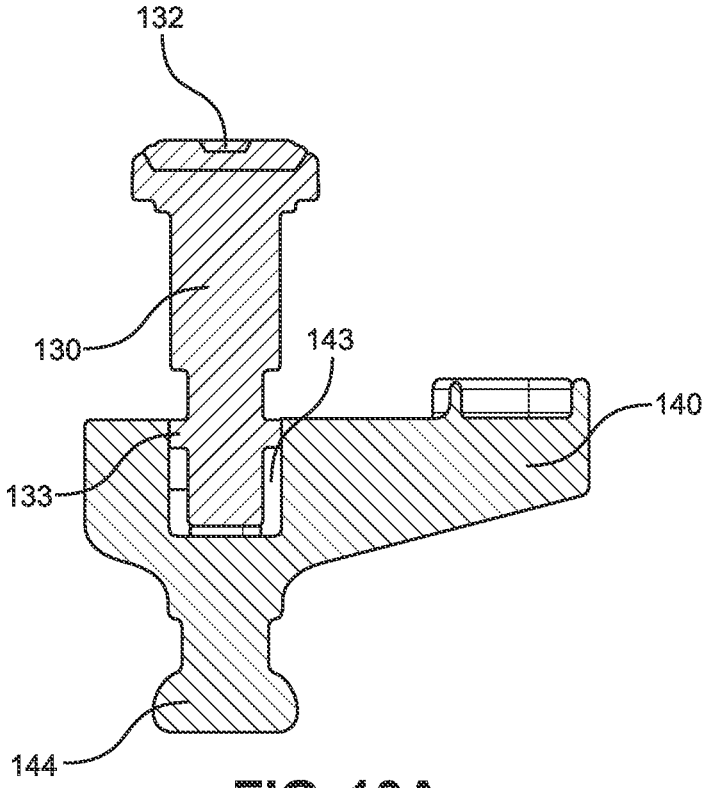
FIG. 10A illustrates in side cross-section view an example piston and carrier assembly for a slide-lock lid according to one embodiment of the present disclosure.
Figure 10B:
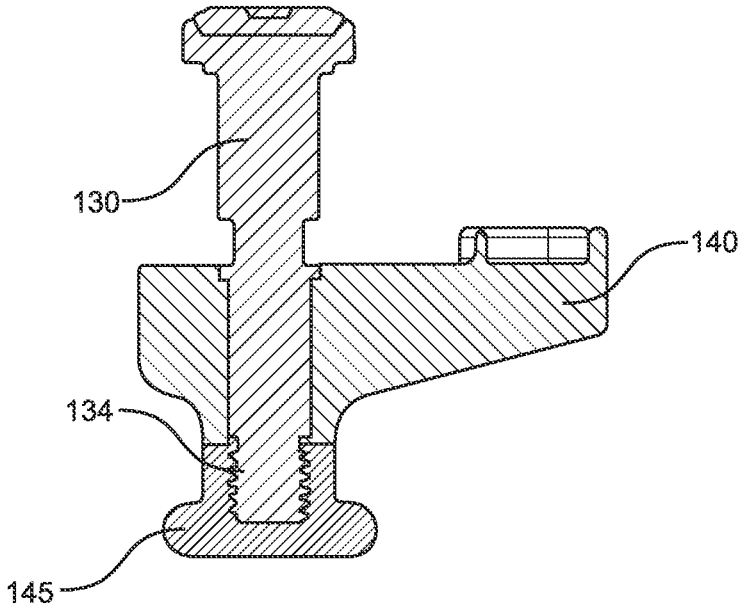
FIG. 10B illustrates in side cross-section view an alternative example piston and carrier assembly for a slide-lock lid according to one embodiment of the present disclosure.

Lastly, FIGS. 10A and 10B illustrate in side cross-section view two examples of a possible piston and carrier assembly for a slide-lock lid. FIG. 10A shows one version of such an assembly, while FIG. 10B shows an alternative version for this assembly. It will be appreciated that either version can be used, and that other arrangements and designs of piston and carrier assemblies can also be used as desired.

As noted above, piston 130 and carrier 140 can be coupled together to form a combined assembly that moves as a single unit, which assembly can also include a beverage seal, a vent seal, or both. In various arrangements, piston 130 can be readily removably coupled from carrier 140. Again, separation of various slide-lock lid components can advantageously facilitate cleaning, maintenance and part maintenance or replacement. In some arrangements, beverage and vent seals can be affixed to the carrier 140 and can be formed of different materials from the carrier, which materials may be more suitable for forming seals against their respective openings.

FIG. 10A shows one possible arrangement where piston 130 is rotatably locked within carrier 140. In this arrangement, protrusions 133 located toward the shaft bottom of piston 130 can insert into a slotted feature 143 that can be integrally formed within a recess in carrier 140. After protrusions 133 have been inserted slotted feature 143, the piston 130 can be rotated to lock the piston within the carrier 140. This can be arranged such that a rotation of one-quarter turn in one direction is sufficient to lock the piston 130 within the carrier 140, and a rotation of one-quarter turn in the opposite direction is sufficient to unlock the piston such that it can be removed from the carrier. Other rotational amounts and arrangements are also possible.

In some arrangements, a coin slot 132 or other similar feature can be located atop the piston 130 to facilitate such a rotation of the piston. Of course, a user can also simply rotate the piston without such an additional coin slot 132 or other similar helpful feature. In addition, a knob 144 or other similar feature can be integrally formed at the bottom of carrier 140 to facilitate gripping and downward pulling by a user when the user wants to override the detent function and remove the slider top assembly from the main outer housing, as noted above.

FIG. 10B shows an alternative possible arrangement for a piston and carrier. Rather than have protrusions and slots, piston can have a threaded region 134 at its bottom end. This bottom end can be placed completely through an opening in the carrier 140 and a locking cap 145 with internal threading can be screwed onto this threaded region 134 to hold the piston and carrier together as a combined assembly. Such a locking cap 145 can be suitably shaped so that a user can then pull on the locking cap to release the function of the detent, as noted above.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. An apparatus, comprising:

an outer housing having a first opening configured for a first fluid to pass therethrough and a second opening configured for a second fluid to pass therethrough;

a top coupled to the outer housing and configured to move relative to the outer housing along a curved path between an open position and a closed position;

a first seal disposed within the outer housing, wherein the first seal is configured to close the first opening when the top is in the closed position and allow the first fluid to pass through the first opening when the top is in the open position; and a second seal disposed within the outer housing, wherein the second seal is configured to close the second opening when the top is in the closed position and allow the second fluid to pass through the second opening when the top is in the open position.

2. The apparatus of claim 1, wherein the apparatus is configured to be a lid for a portable beverage container.

3. The apparatus of claim 2, wherein the first fluid is a beverage, the first opening is a beverage opening, the second fluid is air, and the second opening is an air vent.

4. The apparatus of claim 1, wherein the top is configured to be operated by a user with one hand while the one hand also holds a fluid container associated with the apparatus.

5. The apparatus of claim 1, further comprising:

a carrier disposed within the outer housing, wherein the carrier is configured to move when the top moves relative to the outer housing;

a piston disposed within the outer housing and coupled to the carrier, wherein the piston causes the carrier to move relative to the outer housing when the top moves relative to the outer housing.

6. The apparatus of claim 5, wherein the piston and carrier move vertically as a combined assembly relative to the outer housing when the top moves laterally relative to the outer housing.

7. The apparatus of claim 5, wherein the first seal and the second seal are both coupled to the carrier and the piston is spring-loaded to force the first seal and the second seal to close when the top is in the closed position.

8. The apparatus of claim 5, wherein the top defines a bottom surface having a feature that contacts and moves along the piston when the top moves between the open position and the closed position.

9. The apparatus of claim 8, wherein the feature includes a curved portion that pushes the piston vertically downward as the top moves from the closed position to the open position.

10. The apparatus of claim 1, wherein the top defines a planar upper surface that is disposed at a first angle with respect to the outer housing when the top is in the closed position.

11. The apparatus of claim 10, wherein the planar upper surface is disposed at a second angle with respect to the outer housing when the top is in the open position.

12. The apparatus of claim 11, wherein the difference between the first angle and the second angle is about ten degrees.

13. The apparatus of claim 1, wherein the outer housing includes a cooling well integrally formed therein, the cooling well being configured to allow the first fluid to cool after the first fluid passes through the first opening and is still within the outer housing.

14. The apparatus of claim 1, wherein the top includes integrally formed rails and the outer housing includes integrally formed tracks, and wherein the rails move along the tracks when the top moves between the open position and the closed position relative to the outer housing.

15. A portable beverage container lid, comprising:

an outer housing having a beverage opening configured for a beverage to pass therethrough and a vent opening configured for air to pass therethrough;

a top coupled to the outer housing and configured to move between an open position and a closed position relative to the outer housing, wherein the top defines an upper surface that is disposed at a first angle relative to the outer housing when the top is in the closed position and that is disposed at a second angle that is different than the first angle relative to the outer housing when the top is in the open position;

a beverage seal disposed within the outer housing, wherein the beverage seal is configured to close the beverage opening when the top is in the closed position and to allow the beverage to pass through the beverage opening when the top is in the open position; and a vent seal disposed within the outer housing, wherein the vent seal is configured to close the vent opening when the top is in the closed position and to allow air to pass through the vent opening when the top is in the open position.

16. The portable beverage container lid of claim 15, further comprising:

a carrier disposed within the outer housing, wherein the beverage seal and the vent seal are coupled to the carrier; and a spring-loaded piston disposed within the outer housing and coupled to the carrier, wherein the piston and carrier are configured to move vertically as a combined assembly when the top moves laterally relative to the outer housing.

17. The portable beverage container lid of claim 16, wherein the top defines a bottom surface having a feature that contacts and moves along the piston when the top moves between the open position and the closed position.

18. The portable beverage container lid of claim 16, wherein the piston is removably coupled to the carrier such that none of the piston, carrier, top, beverage seal, and vent seal can be removed from the outer housing when the piston and carrier are coupled together within the portable beverage container lid, while the piston, carrier, top, beverage seal, and vent seal can all be readily removed from the outer housing when the piston is uncoupled from the carrier while the piston and carrier are within the outer housing.

19. The portable beverage container lid of claim 15, wherein moving the top to the open position opens both the beverage seal and vent seal simultaneously.

20. A portable beverage container, comprising:

a main reservoir configured to hold a beverage therein; and a lid removably coupled to the main reservoir, the lid including:

an outer housing having a beverage opening configured for the beverage to pass therethrough and a vent opening configured for air to pass therethrough, a top coupled to the outer housing and configured to move relative to the outer housing along a curved path between an open position and a closed position, a beverage seal disposed within the outer housing, wherein the beverage seal is configured to close the beverage opening when the top is in the closed position and allow the beverage to pass through the beverage opening when the top is in the open position, and a vent seal disposed within the outer housing, wherein the vent seal is configured to close the vent opening when the top is in the closed position and to allow air to pass through the vent opening when the top is in the open position.

* * * * *